US007696929B2

(12) United States Patent
Kaneda

(10) Patent No.: US 7,696,929 B2
(45) Date of Patent: Apr. 13, 2010

(54) TUNABLE MICROSTRIP DEVICES

(75) Inventor: Noriaki Kaneda, Westfield, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 180 days.

(21) Appl. No.: 11/937,561

(22) Filed: Nov. 9, 2007

(65) Prior Publication Data

US 2009/0121951 A1 May 14, 2009

(51) Int. Cl.
*H01Q 1/38* (2006.01)

(52) U.S. Cl. ..... 343/700 MS; 343/745

(58) Field of Classification Search ..... 343/700 MS, 343/702, 745

See application file for complete search history.

(56) References Cited

U.S. PATENT DOCUMENTS

| | | | | |
|---|---|---|---|---|
| 4,757,287 | A | 7/1988 | Grandfield et al. | |
| 5,825,263 | A | 10/1998 | Falt | |
| 6,369,760 | B1 | 4/2002 | Nalbandian et al. | |
| 6,417,807 | B1 * | 7/2002 | Hsu et al. | 343/700 MS |
| 6,677,901 | B1 | 1/2004 | Nalbandian | |
| 6,717,491 | B2 | 4/2004 | Liang et al. | |
| 6,946,999 | B1 | 9/2005 | Ryken et al. | |
| 6,995,635 | B2 | 2/2006 | Wung et al. | |
| 7,046,196 | B1 | 5/2006 | Langley et al. | |
| 7,106,151 | B1 | 9/2006 | Honeycutt et al. | |
| 7,145,510 | B2 | 12/2006 | Liu et al. | |
| 2003/0219035 | A1 * | 11/2003 | Schmidt | 370/478 |
| 2008/0062047 | A1 * | 3/2008 | Iwata et al. | 343/700 MS |

OTHER PUBLICATIONS

K. L. Virga and Y. Rahmat-Samii, Low-Profile Enhanced-Bandwidth PIFA Antennas for Wireless Communications Packaging, IEEE Trans on Microwave Theory and Techniques, vol. 45, No. 10, Oct. 1997, pp. 1879-1888.

Xiao-Peng Liang and Yongfei Zhu, "Hybrid Resonator Microstrip Line Electrically Tunable Filter," 2001 IEEE MTT-S Digest, pp. 1457-1460.

T. Paillot et al., "Implementation of a Tunable Coplanar Filter," 2003 IEEE MTT-S Digest, pp. 1755-1758.

Laurent Dussopt and Gabriel M. Rebeiz, "Intermodulation Distortion and Power Handling in RF MEMS Switches, Varactors, and Tunable Filters," IEEE Trans on Microwave Theory and Techniques, vol. 51, No. 4, Apr. 2003, pp. 1247-1256.

Winter Dong Yan and Raafat R. Mansour, "Tunable Dielectric Resonator Bandpass Filter with Embedded MEMS Tuning Elements" IEEE Trans on Microwave Theory and Techniques, vol. 55, No. 1, Jan. 2007, pp. 154-160.

Cesar Lugo, Jr. and John Papapolymerou, "Six-State Reconfigurable Filtelr Structure for Antenna Based Systems,", IEEE Trans on Antennas and Propagation, vol. 54, No. 2, Feb. 2006, pp. 479-483.

Leo G. Maloratsky, "Reviewing the Basics of Microstrip Lines," Microwaves & RF, Mar. 2000, pp. 79-88.

* cited by examiner

*Primary Examiner*—Trinh V Dinh
*Assistant Examiner*—Dieu Hien T Duong
(74) *Attorney, Agent, or Firm*—Wall & Tong, LLP

(57) ABSTRACT

Tunable microstrip devices formed by capacitively coupled conductive strips are disclosed. Device parameters can be tuned by adjusting corresponding lengths of a resonator and a coupling section of the device by connecting one or more auxiliary segments to the conductive strips.

20 Claims, 14 Drawing Sheets

TUNABLE MICROSTRIP DEVICES

FIELD OF THE INVENTION

The present invention generally relates to tunable microstrip devices and methods of forming and using such devices.

BACKGROUND

Microstrip components such as filters and antennas are widely used in telecommunications. Different techniques have been used to achieve frequency tuning of the components, including for example, using varactors.

BRIEF SUMMARY

Some embodiments relate to tunable microstrip devices. Some of the embodiments may provide tunable filters with lower insertion losses and/or larger tuning ranges than similar tunable filters based on varactor diodes.

One embodiment provides a tunable microstrip device that includes a first conductive strip, a second conductive strip and a set of micro-electromechanical system (MEMS) switches. The first and second conductive strips are provided on a single plane and separated from a conductive ground plane by a dielectric substrate. The first conductive strip has a main segment and a first group of auxiliary segments disposed to form a physical series at a first end of the main segment. Each auxiliary segment is associated with a corresponding micro-electromechanical system (MEMS) switch. The first conductive strip has a first capacitive coupling section that includes a portion of the main segment and one or more of the auxiliary segments of the first group. The first capacitive coupling section has a first side that is separated from a first side of the second conductive strip by a gap. A first of the MEMS switches of the first set is adapted to electrically connect a first of the auxiliary segments to the first end of the main segment, and each of the other MEMS switches is adapted to electrically connect a corresponding one of the auxiliary segments to one of the auxiliary segments closer to the main segment in the series. Each of the MEMS switches of the first set is disposed at a second side of the first capacitive coupling section that is farther away from the second conductive strip than the first side of the capacitive coupling section.

Another embodiment provides a method of tuning a microstrip device. The method includes configuring a first conductive strip and a second conductive strip on a single plane for capacitive coupling, with a first side of the first conductive strip being separated from a first side of the second conductive strip by a gap. The first conductive strip has a main segment and a first group of auxiliary segments, with the auxiliary segments forming a physical series at a first end of the main segment. A first set of micro-electromechanical system (MEMS) switches is provided at a second side of the first conductive strip that is farther away from the second conductive strip than the first side of the first conductive strip, and each of the MEMS switches of the first set is associated with a corresponding auxiliary segment of the first group. A parameter of the device is tuned by electrically connecting at least a first of the auxiliary segments of the first group to the first end of the main segment using a first of the MEMS switches of the first set.

BRIEF DESCRIPTIONS OF THE FIGURES

The teachings of various embodiments can be readily understood by considering the following detailed description in conjunction with the accompanying drawings, in which:

FIGS. 1A-C are schematic illustrations of a tunable microstrip antenna according to different embodiments;

Figure 3A:
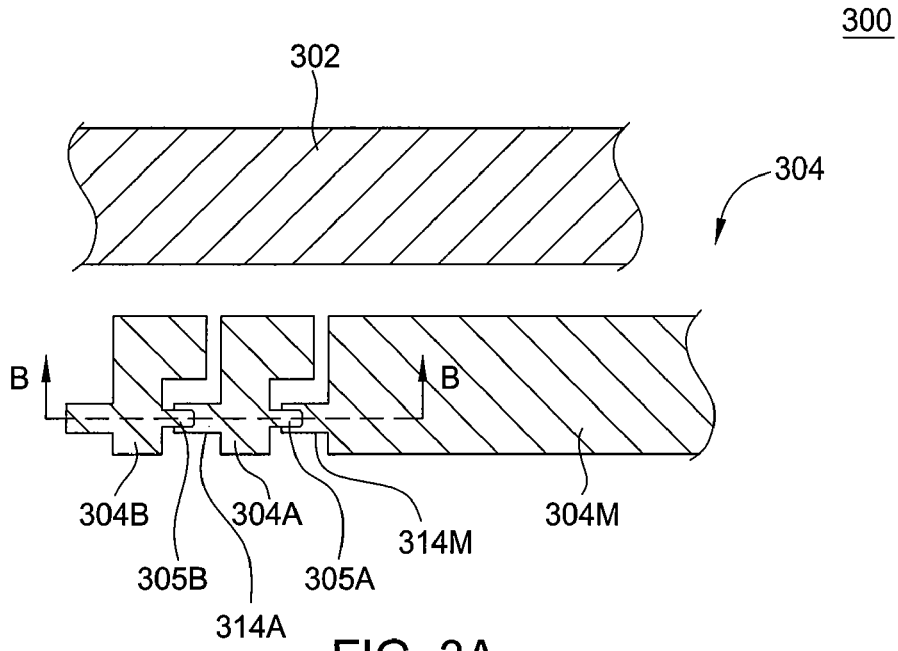
FIG. 3A is a schematic illustration of a top view of a portion of a tunable microstrip device according to another embodiment.
Figure 3B:
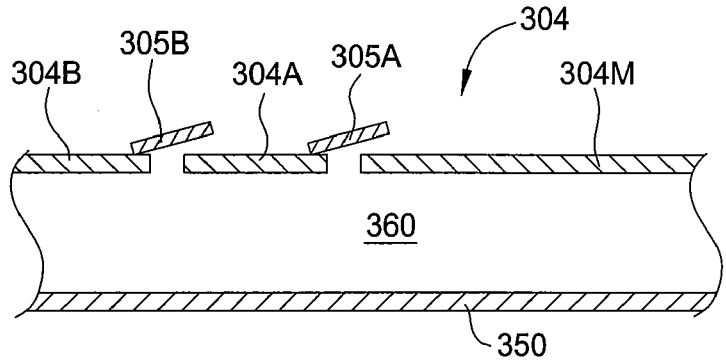
Figure 3C:
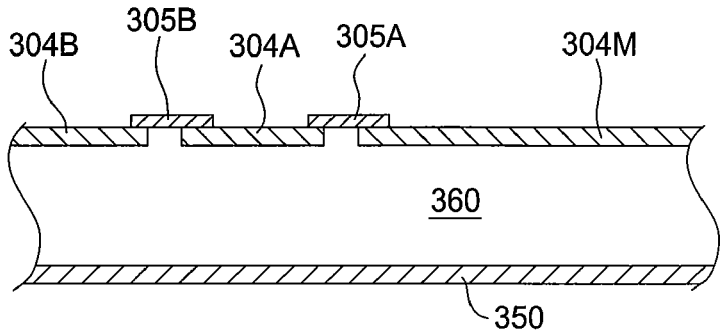
Figure 3D:
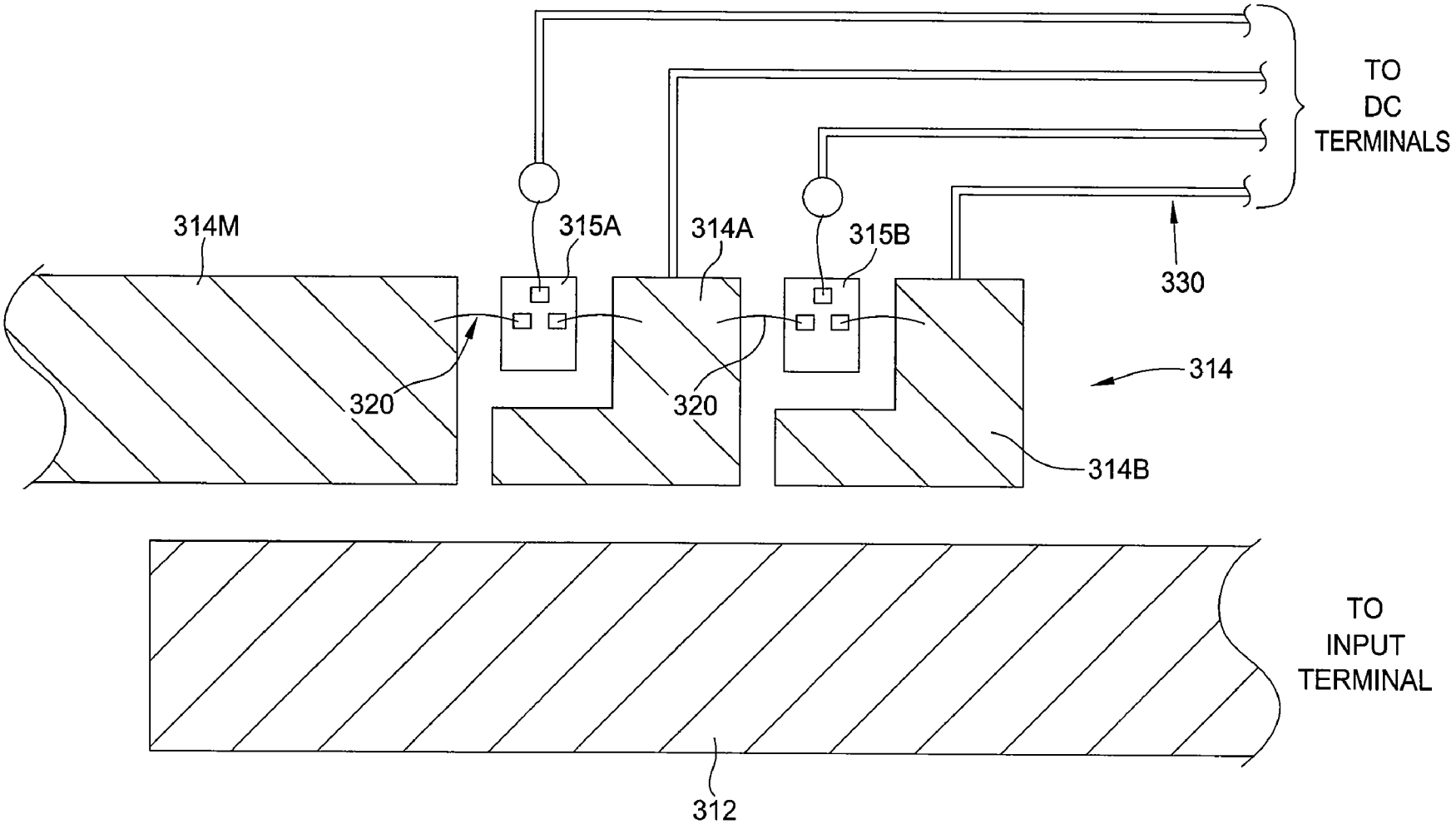
Figure 4:
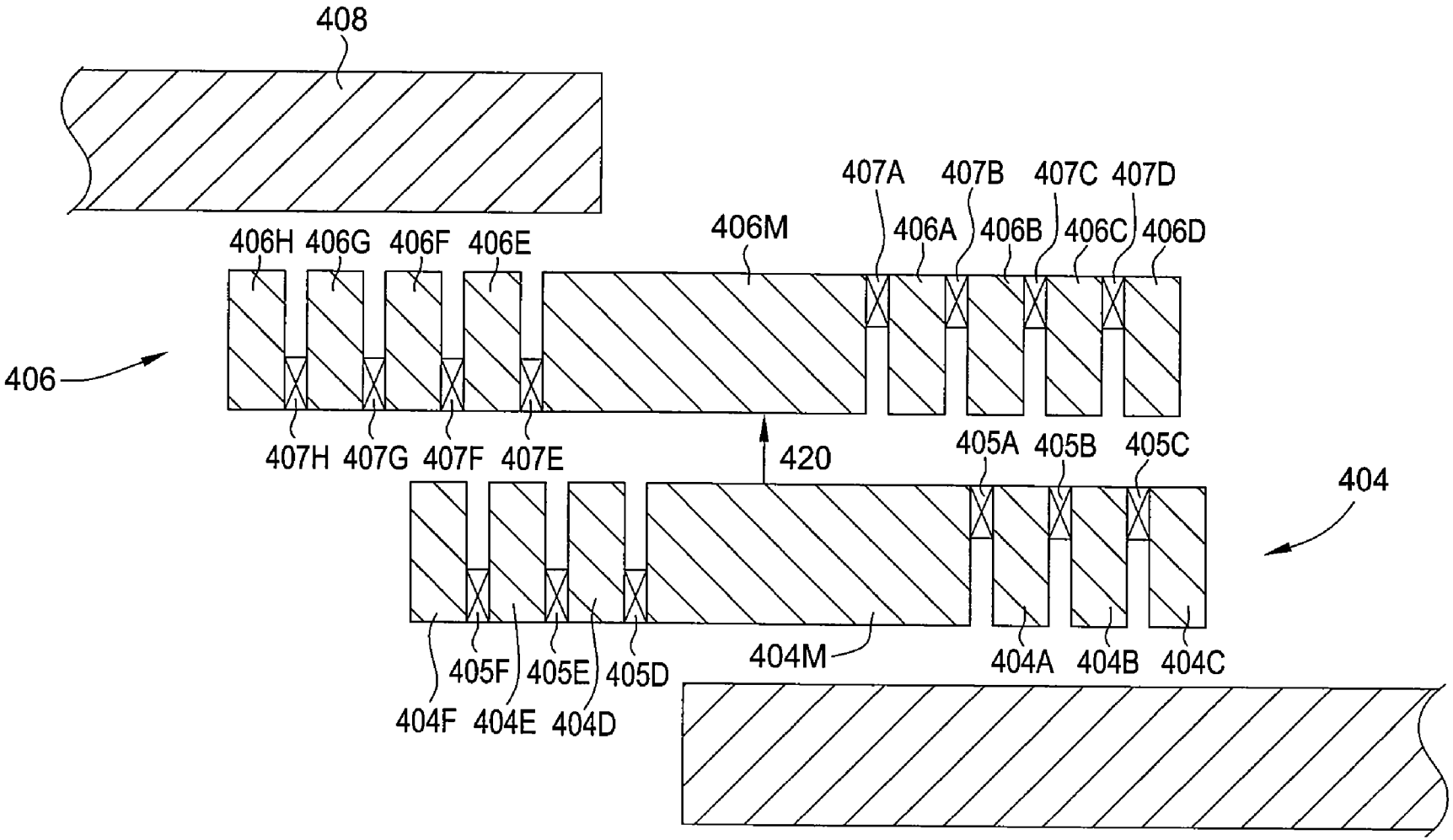
Figure 5:
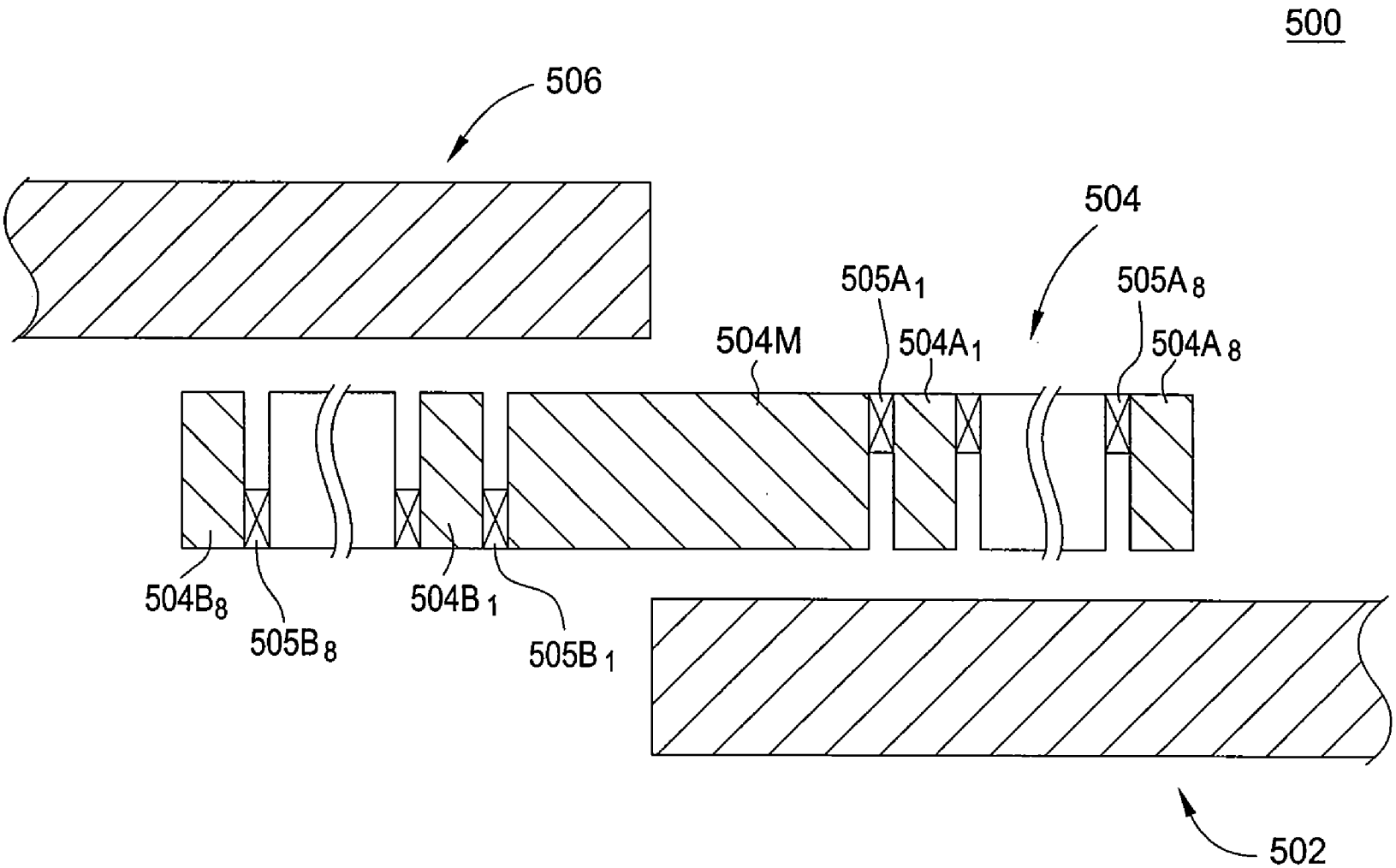
Figure 6A:
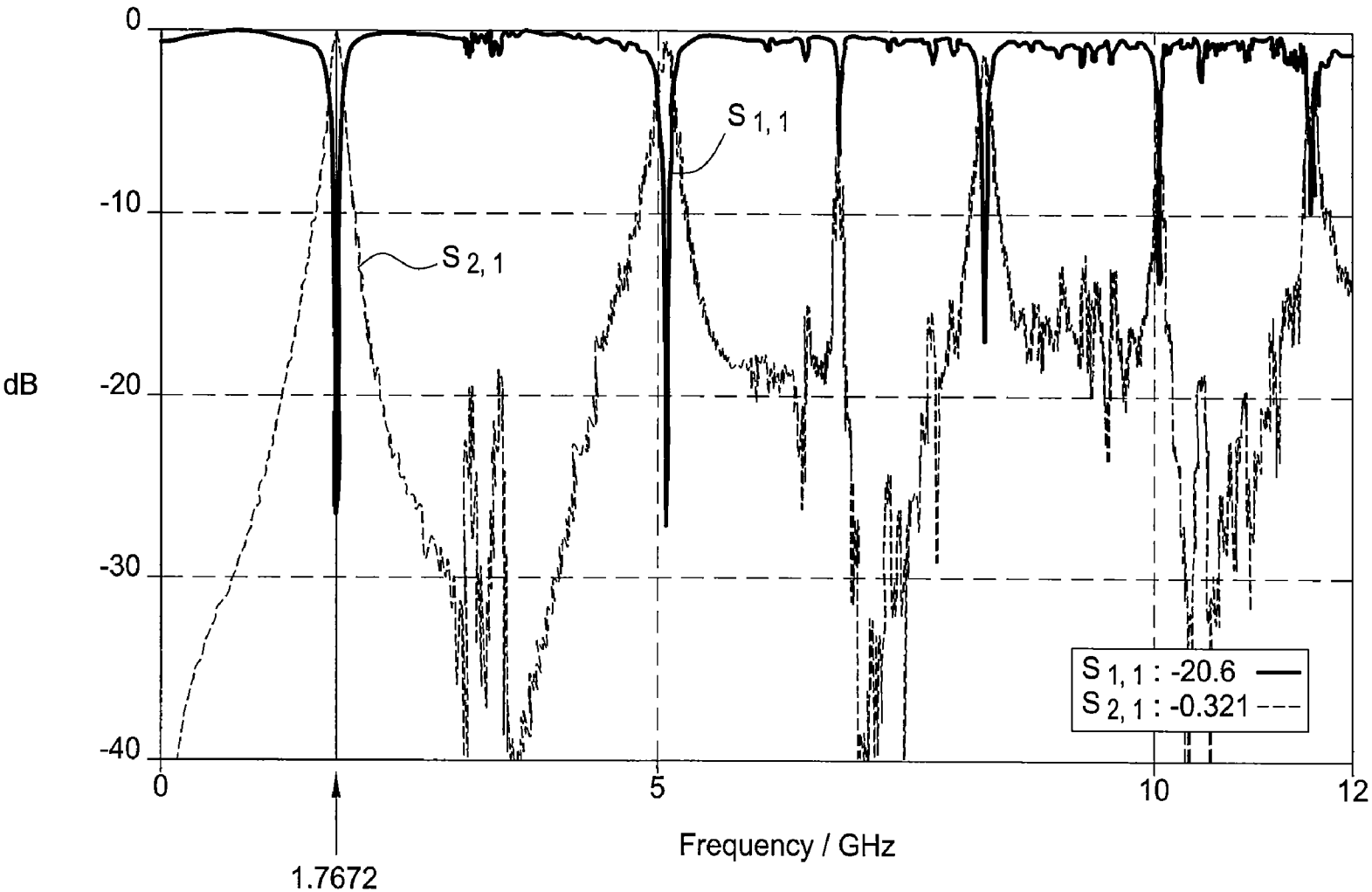
Figure 6B:
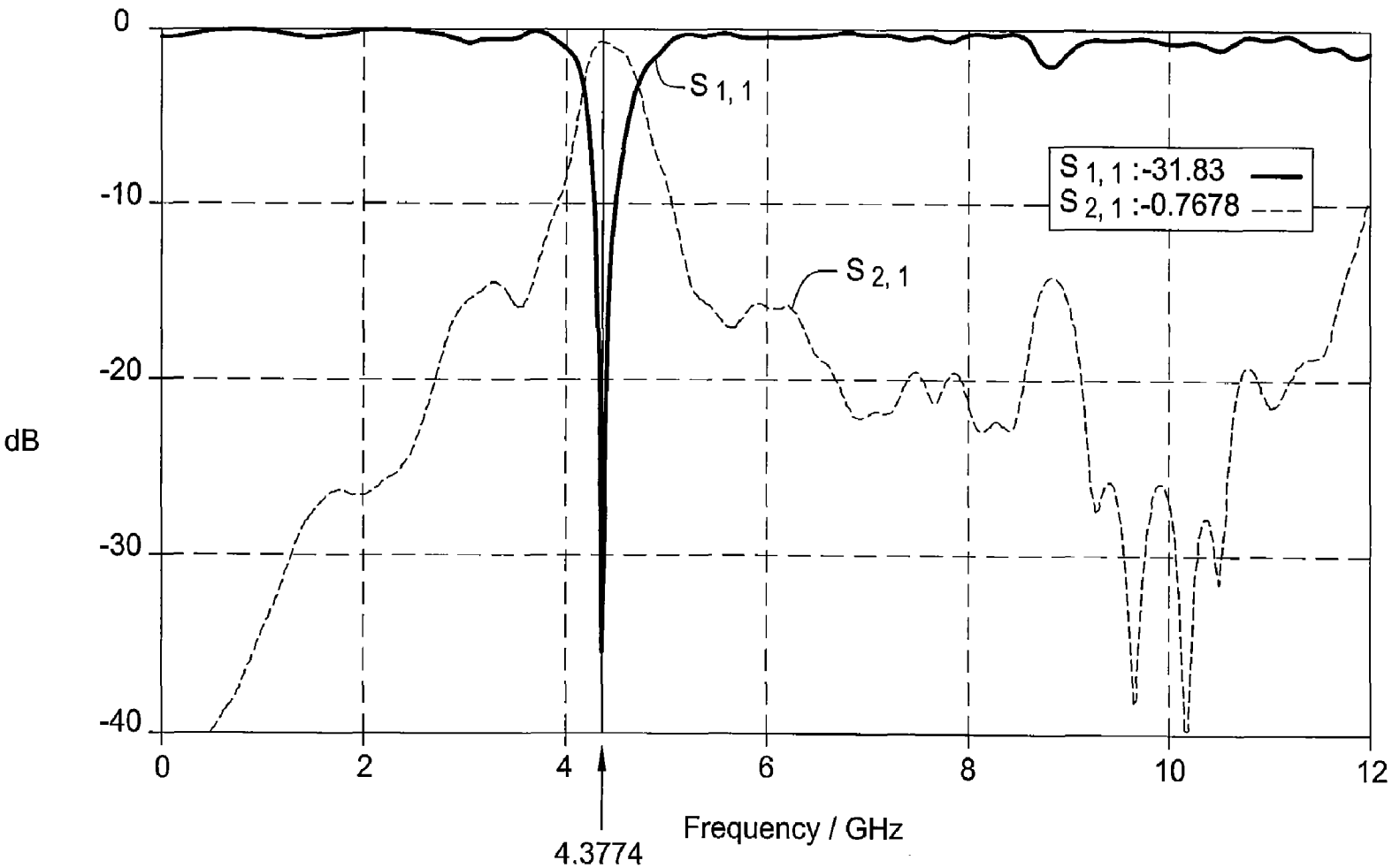
Figure 7A:
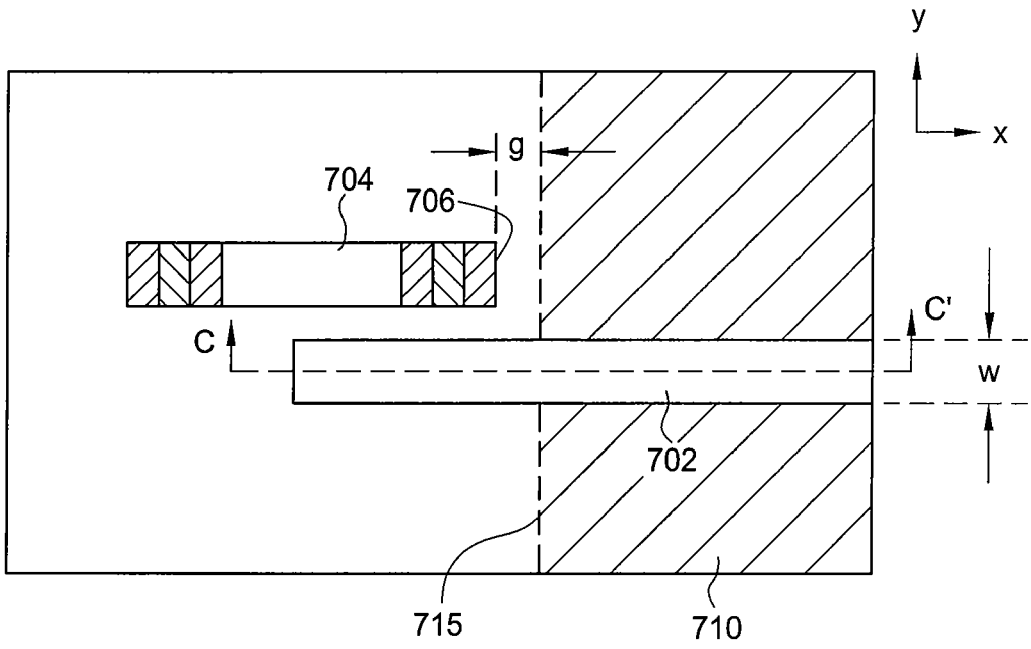
Figure 7B:
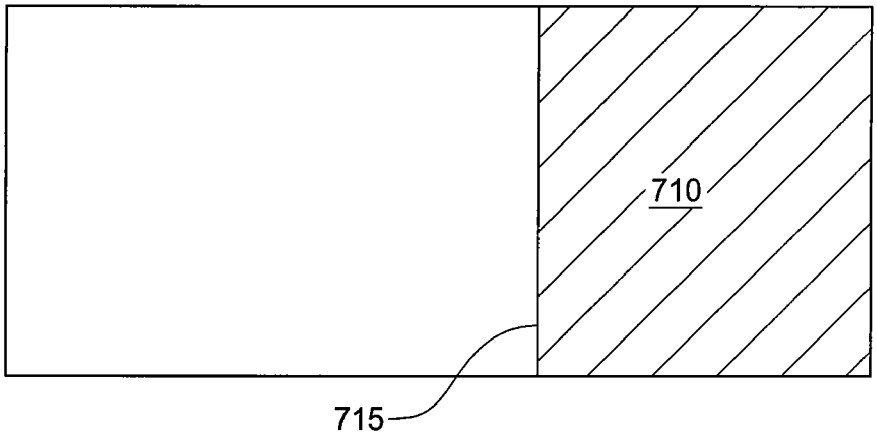
Figure 7C:
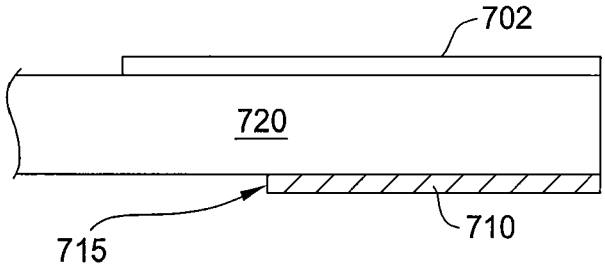
Figure 8A:
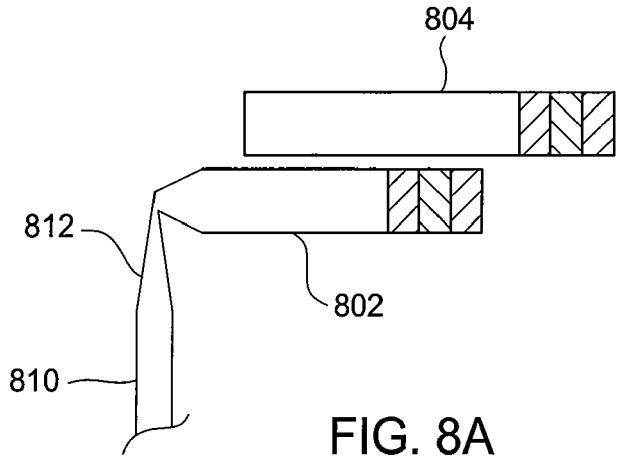
Figure 8B:
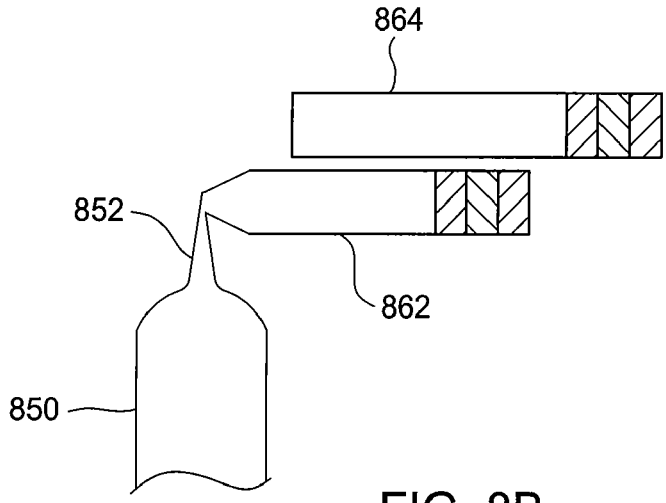
Figure 8C:
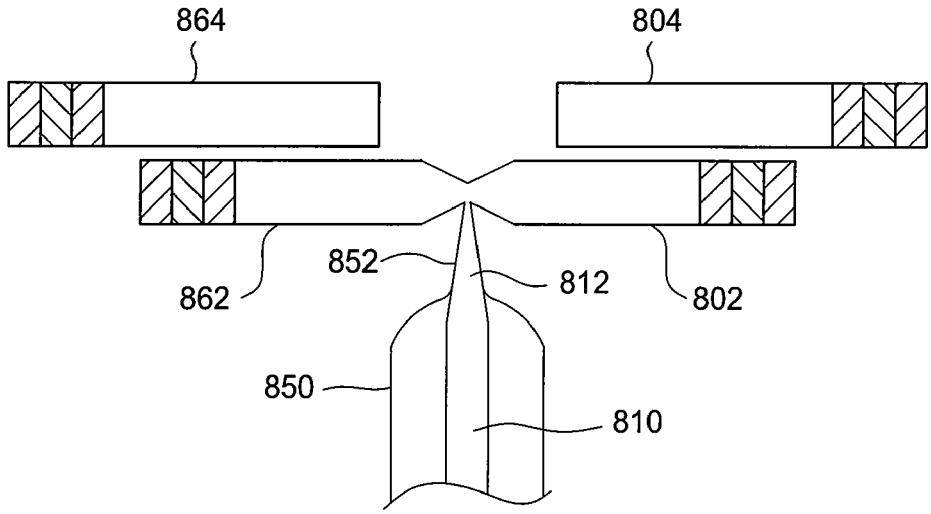
Figure 9A:
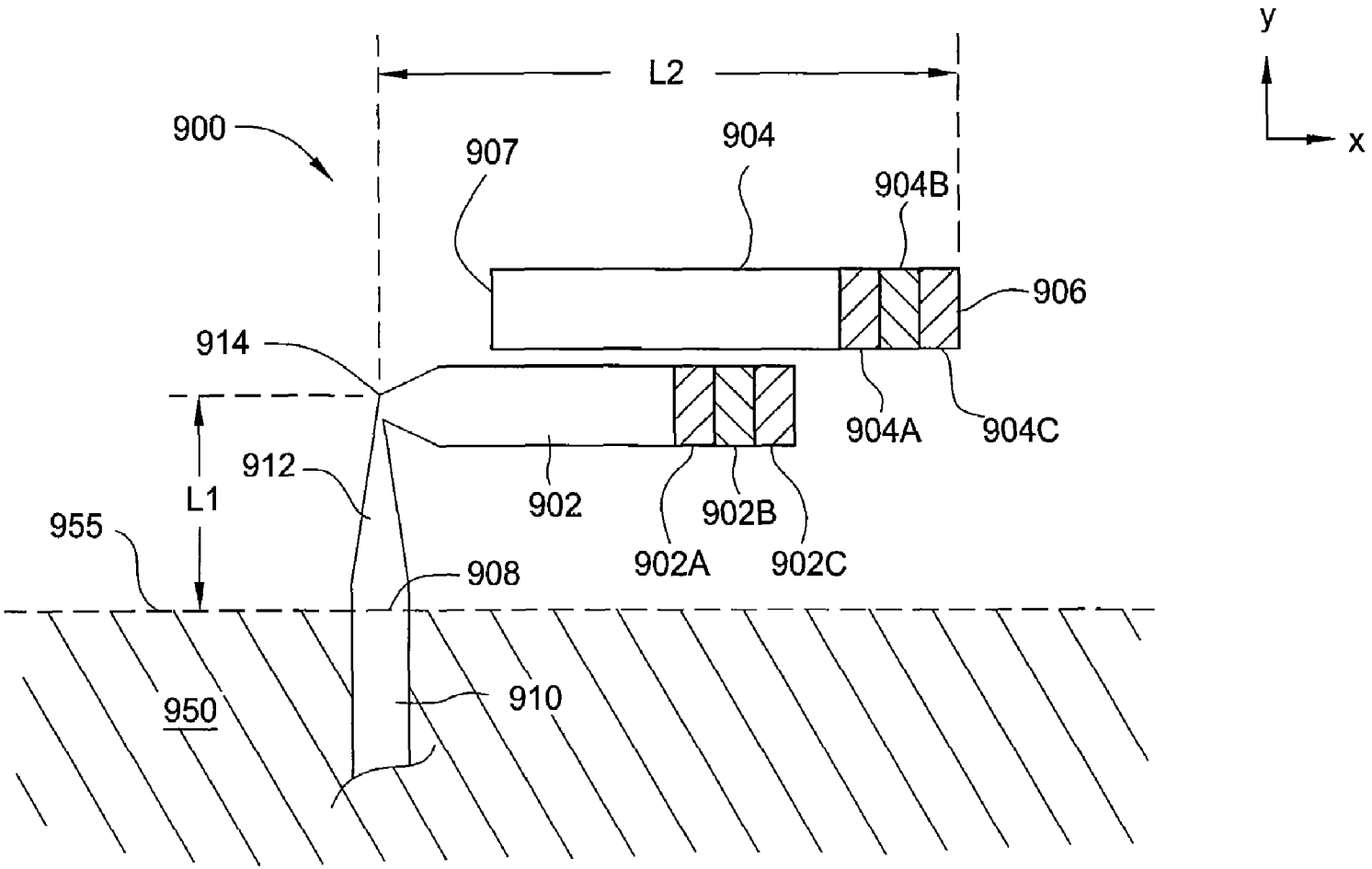
Figure 9B:
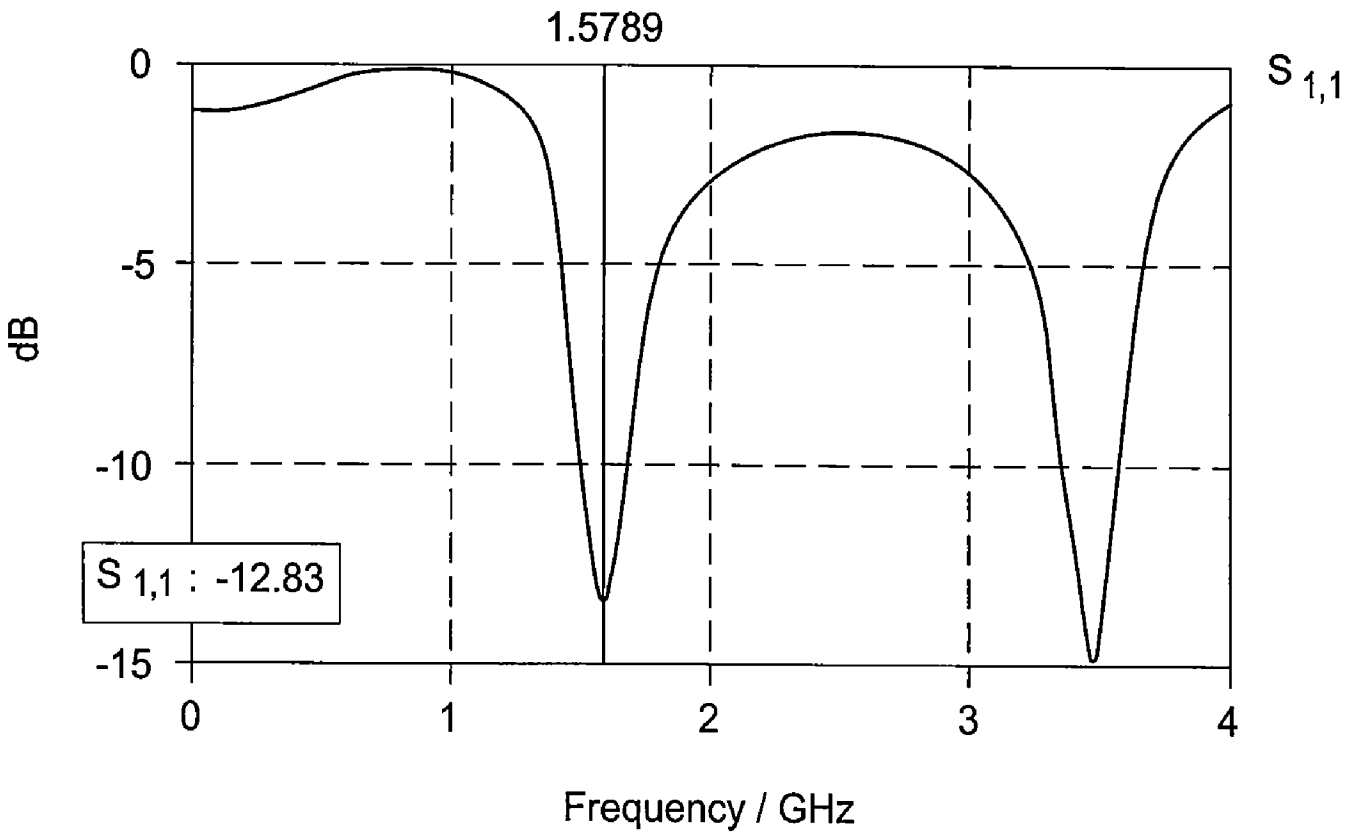
Figure 10:
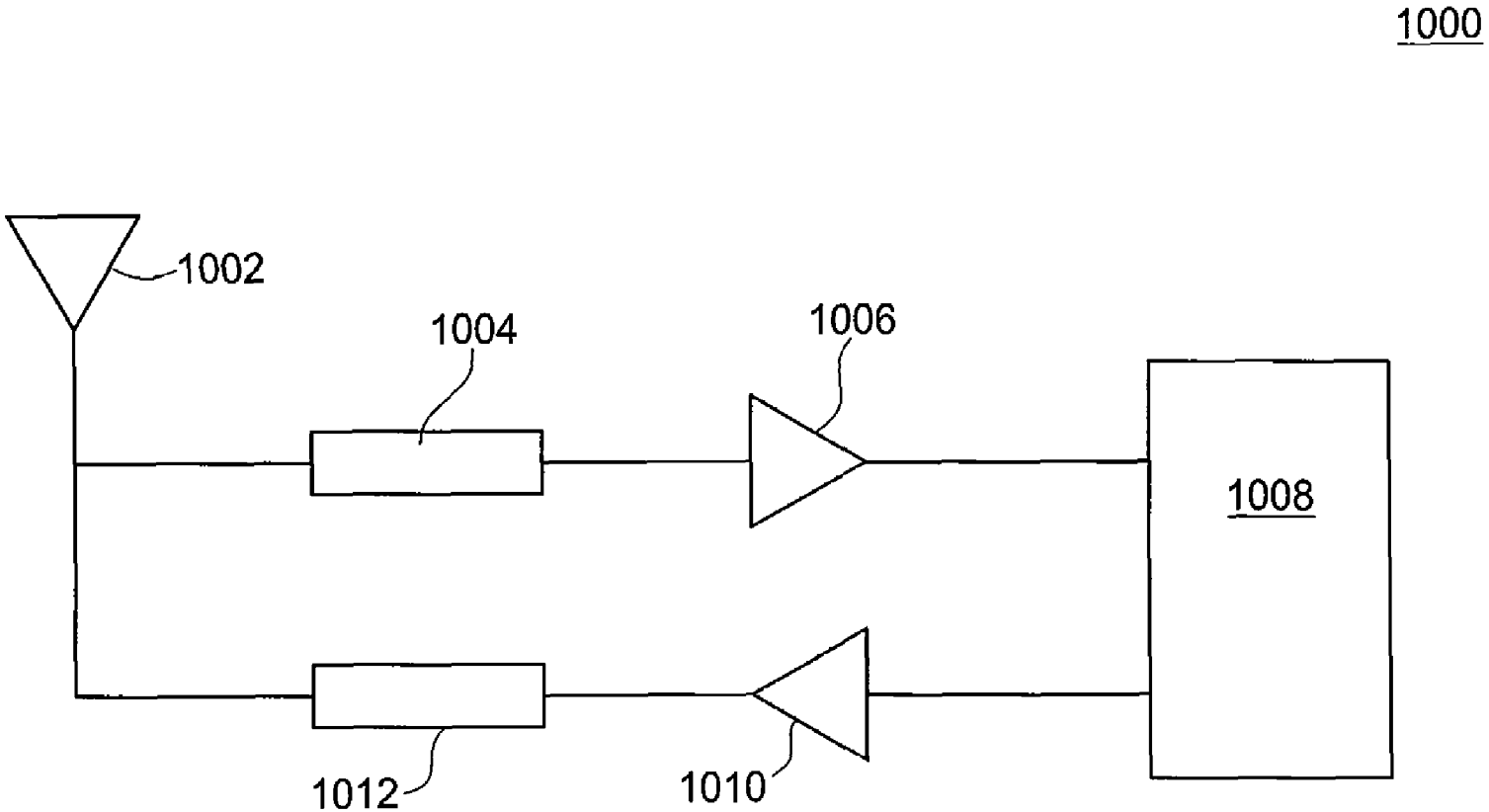

FIGS. 3B-C are schematic illustrations of a cross-section view of a portion of the tunable microstrip device of FIG. 3A;

FIG. 3D is a schematic illustration of one embodiment of a portion of a tunable microstrip device;

FIG. 4 is a schematic illustration of a multiple resonator filter according to another embodiment;

FIG. 5 is a schematic illustration of one embodiment of a tunable filter with 16 switchable elements;

FIGS. 6A-B illustrate the results from a simulation of the tunable microstrip filter shown in FIG. 5;

FIGS. 7A-C are schematic illustrations of a tunable antenna according to another embodiment;

FIGS. 8A-C are schematic illustrations of different views of a tunable antenna according to another embodiment;

FIG. 9A is a schematic illustration of a tunable antenna according to another embodiment;

FIG. 9B illustrates the result from a simulation of an example of the tunable antenna of FIG. 9A; and FIG. 10 is a schematic diagram illustrating the use of a tunable microstrip component of various embodiments in multi-band, multi-service systems.

To facilitate understanding, identical reference numerals have been used, where possible, to designate elements with similar or identical structures and/or similar or identical functions in the figures.

DETAILED DESCRIPTION

Various embodiments provide a tunable microstrip component formed by parallel coupled microstrip lines with one or more switchable elements for adjusting a resonant length of the component. The tunable component, which may be an antenna or a filter, may be used in tunable receivers for a variety of applications such as surveillance systems, or multi-band, multi-service systems.

Figures 1A, 1B:
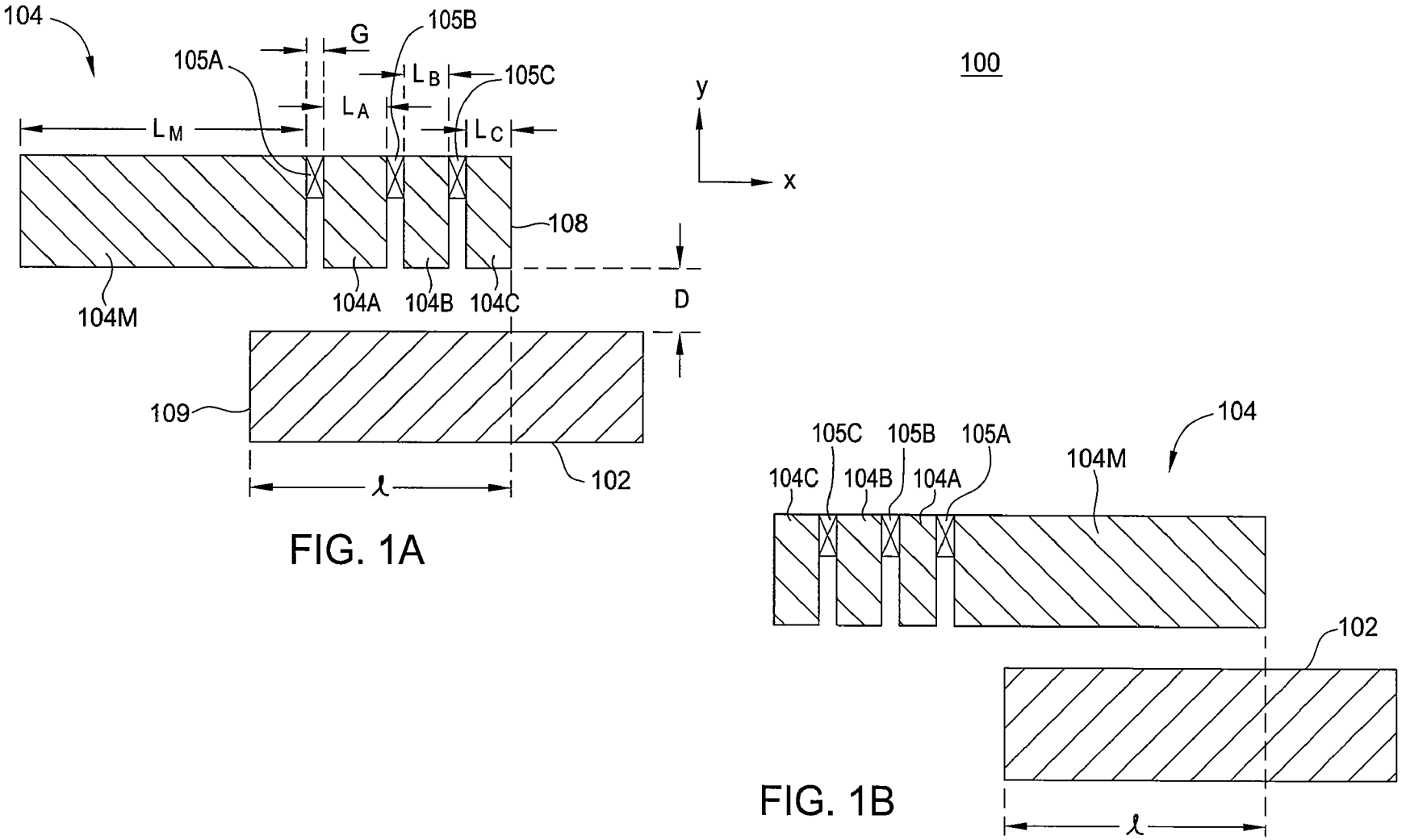
Figure 1C:
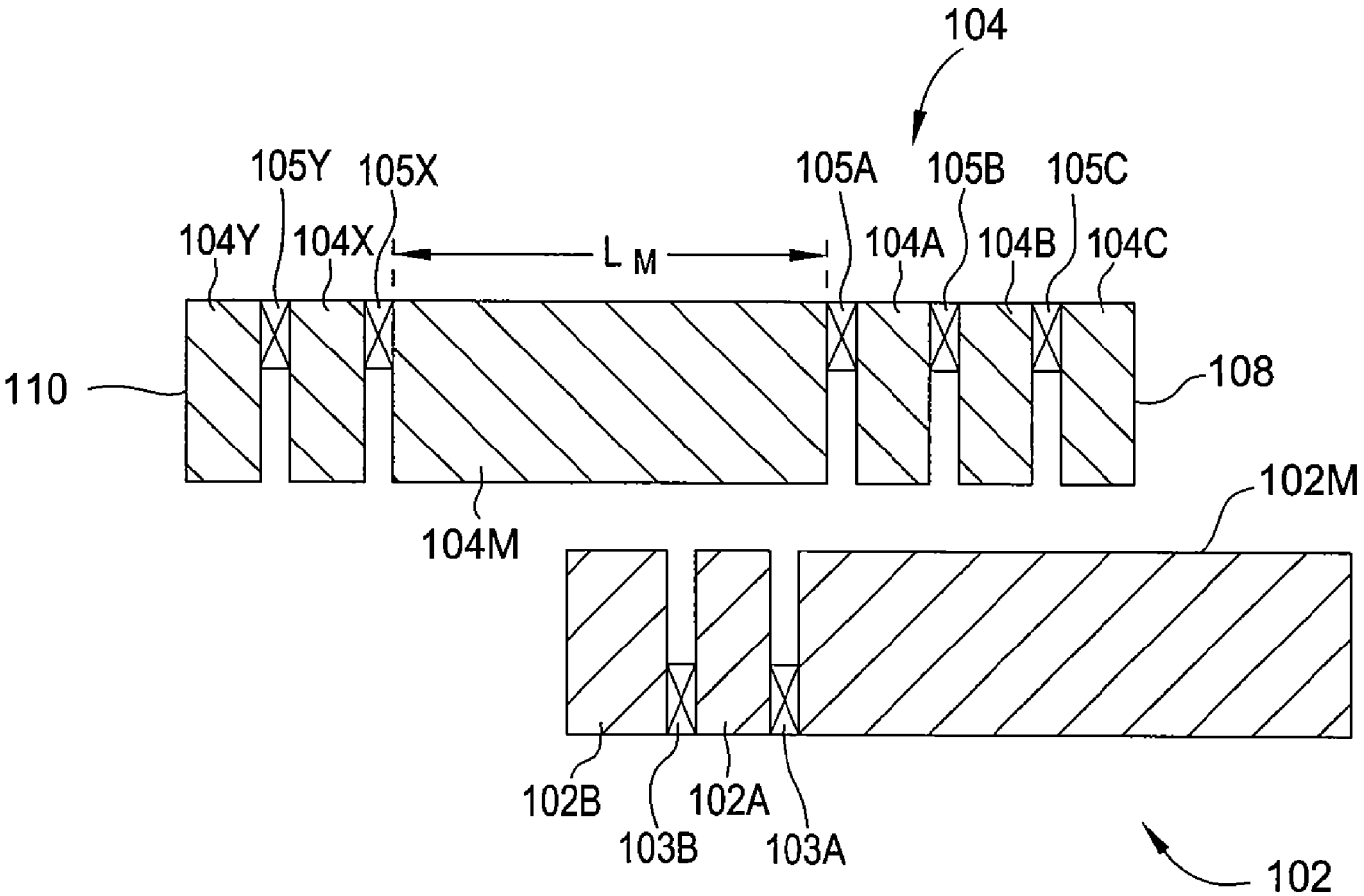

FIGS. 1A-C are schematic top views of different embodiments of a tunable antenna 100, which has parallel coupled microstrip lines. As is customary for microstrip devices, the top view structures shown in FIG. 1 as well as those in FIGS. 2-5 are conductive patterns printed on a dielectric substrate backed by a metal ground plane. In each of the configurations of FIGS. 2-5, the ground plane is assumed to be a continuous plane. Similar configurations can be used for tunable dipole antenna with tunable center frequency. Other variations, including for example, modifications to the ground plane will be discussed in later sections.

As shown in FIG. 1A, two conductive strips 102, 104 are disposed in the x-y plane, substantially parallel to each other. The strips 102, 104 are also disposed in spaced adjacency to each other, e.g., being adjacent to and separated by a distance from each other (e.g., D along the y-direction). In this example, the conductive strip 102 serves as a signal input line that feeds input signal to antenna, and the conductive strip 104 serves as the radiating element of the antenna 100. The conductive strips 102 and 104 are the signal trace of the microstrip lines and typically rectangular in shape, and are usually made of the same metals, e.g., copper, gold, aluminum, silver and alloys or multi-layers thereof.

In this embodiment, the conductive strip 104 includes a main segment 104M and a group of one or more auxiliary segments or tuning elements, e.g., 104A, 104B, 104C. The auxiliary segments 104A, 104B and 104C are disposed serially at one end of the main segment 104M. A two-position switch 105A is provided between the main segment 104M and the first auxiliary segment 104A. When switch 105A is in its normally open (or off) position, the main segment 104M and auxiliary segment 104A are disconnected from each other. When switch 105A is in its closed (or on) position, the main segment 104M and auxiliary segment 104A are electrically connected. In one embodiment, switch 105A is a microelectromechanical system (MEMS) switch, which can be made of standard materials, e.g., silicon-based materials. In another embodiment, switch 105A is a PIN diode or any type (e.g., GaAs, BST, silicon) of varactor diode or MEMS varactor to provide continuous (analog) tuning capability.

As shown in FIG. 1A, a switch is also provided between any two adjacent auxiliary segments in the group, e.g., switch 105B between auxiliary segments 104A and 104B, and switch 105C between auxiliary segments 104B and 104C. In general, each auxiliary segment has a corresponding switch, which is used to connect that auxiliary segment to the adjacent segment nearer to the main segment 104M. These auxiliary segments may also be referred to as "switchable" auxiliary segments. In this example, switch 105A can connect auxiliary segment 104A to the main segment 104M, and switch 105C can connect auxiliary segment 104C to adjacent segment 104B.

In one embodiment, auxiliary segments 104A, 104B and 104C are substantially rectangular shaped, and have respective lengths $L_A$, $L_B$ and $L_C$, which are generally smaller than the length $L_M$ of the main segment 104M. Each of $L_A$, $L_B$ and $L_C$ may have different values, or may be equal to each other.

The resonator of antenna 100 includes the main segment 104M and any auxiliary segments 104A-104C that are electrically connected to 104M. In this context, auxiliary segments 104A-104C that are only indirectly electrically connected to the main segment 104M via other auxiliary segments are also part of the resonator.

By electrically connecting one or more auxiliary segments 104A, 104B and 104C to the main segment 104M using switches 105A, 105B and 105C, the resonator length L may be adjusted in respective increments of lengths $L_A$+G, $L_B$+G, and $L_C$+G. Here, G represents generally the gap length (may also be the length of a switch's connector) between adjacent segments. The gap widths, G, between different segments may be equal or different. In practice, the gap G could be as large as about 20% of the segment length. Typically, each gap is wide enough, e.g., has a low capacitance, so that adjacent segments 104M-104C will not be significantly electrically connected at operating frequencies of the antenna 100 when the gap's switch 105A-105C is open. However, since the electromagnetic wave does not usually couple well in this direction, in one example of a segment length of about 1.5 mm, the gap can be as narrow as about 0.2 mm for this particular example.

For example, a resonator length $L_M$+$L_A$+G can be obtained by connecting only the first auxiliary segment 104A (switch 105A on) to the main segment 104M. A length of $L_M$+$L_A$+$L_B$+2G can be obtained by connecting both the first and the second auxiliary segments 104A, 104B to the main segment 104M (switches 105A and 105B both on), wherein it is assumed, in this example, that both gaps have the same width.

Since the resonant length L is related to the center wavelength $\lambda_g$ of the antenna 100 by approximately $L=\lambda_g/2$, a tuning frequency range from about 3.8 GHz to about 6.1 GHz can be achieved by providing a minimum resonant length of about 3.0 cm and a maximum resonant length of about 5.0 cm. Furthermore, since the length of each auxiliary segment directly correlates with the frequency tuning interval, a finer frequency tuning over a larger range would favor the use of a larger number of auxiliary segments with shorter segment lengths.

In the embodiment shown FIG. 1A, a capacitive coupling section in the first conductive strip 104 is formed by a portion of the main segment 104M and the auxiliary segments 104A, 104B and 104C. The capacitive coupling is the electrical coupling of conductors with a capacitive component in between, which, in this case, is the air between the two conductive strips. This coupling section is adjacent to and may be parallel to the second conductive strip 102. The strength of the resulting capacitive coupling is determined in part by the length of this coupling section. The coupling length (l), which corresponds to the length (in the x-direction) from one end 109 of the conductive strip 102 to a distal end 108 of the last auxiliary segment (104C in this case) of conductive strip 104, is also effectively tuned by the on/off state of the respective switches 105A, 105B and 105C. In this configuration, the resonator length and the capacitive coupling are varied at the same time by connecting one or more of the auxiliary segments.

Other characteristics of the microstrip device 100 can be adjusted by varying other parameters. For example, a smaller separation between the conductive strips 104 and 102 (i.e., smaller value of D) results in stronger coupling. In one example, D is selected to be significantly smaller than $\lambda_g$.

The bandwidth the antenna can be adjusted by varying the width of the strip 104, or by varying the dielectric substrate thickness. The width of the feed line strip 102 is usually selected, based on the substrate material and thickness to provide 50 ohm impedance, while the width of the resonator strip 104 can be selected primarily to adjust the bandwidth.

In this example, switches 105A, 105B and 105C are disposed on a side of the conductive strip 104 farther away (in the y-direction) from the conductive strip 102, e.g., the "non-coupling" side. This configuration has the advantage of avoiding undesirable interference with electromagnetic wave coupling (between the conductive strips 102 and 104), e.g., unwanted reflection, scattering loss and so on, which may otherwise arise if the switches were placed closer to the coupling side. In addition, the DC bias lines or wires that are associated with the switches may also deteriorate the device performance.

FIG. 1B shows another embodiment in which the conductive strip 104 has the auxiliary segments 104A, 104B and 104C serially arranged on the other end of the main segment 104M. In this configuration, the capacitive coupling length (l) of the antenna is not affected by the on/off states of the switches 105A, 105B and 105C. Instead, by connecting the segments 104A, 104B, and 104C sequentially to the main segment 104M, one can tune the resonator length in respective increments (corresponding to the respective segment and gap lengths). Thus, the central frequency of the antenna can be tuned without affecting the capacitive coupling length. Again, the inter-segment gaps are wide enough such that the segment 104M and the segments 104A, 104B, 10C do not have significant capacitive coupling when the corresponding switches 105A, 105B, 105C are open.

FIG. 1C shows an alternative embodiment in which conductive strip 102 is also divided into a main segment 102M separated from one or more auxiliary segments 102A and 102B by switches 103A and 103B. Thus, the capacitive coupling length (l) between conductive strips 102 and 104 can be adjusted by connecting segment 102A to 102M using switch 103A, and if desired, further connecting segment 102B to 102A using switch 103B. Again, the switches 103A, 103B are provided on the side of the strip 102 that is farther away from the strip 104, i.e., the non-coupling side of strip 102. Also, the inter-segment gaps are wide enough such that the segment 102M and the segments 102A, 104B do not have significant capacitive coupling when the corresponding switches 103A, 103B are open.

In this example, the capacitive coupling has a minimum value when switches 105A and 103A are both "off", thus disconnecting the auxiliary segments 104A and 102A (and any subsequent ones) from their respective main segments. A maximum capacitive coupling can be obtained by having switches 103A, 103B, 105A, 105B and 105C all being "on", thus connecting segments 102A and 102B to the main segment 102M, and segments 104A, 104B and 104C to the main segment 104M. Again, the capacitive coupling length can be tuned in increments corresponding to the respective segment lengths and gap widths.

In one embodiment, switches 103A and 103B are MEMS switches. In other embodiments, switches 103A and 103B are PIN diodes, or varactor diodes as previously mentioned.

FIG. 1C also illustrates another embodiment of conductive strip 104, which is provided with two groups of auxiliary segments, one at each end of the main segment 104M. The first group of auxiliary segments (104A, 104B and 104C) is provided for connecting to a first end 108 of the main segment 104M via respective switches 105A, 105B and 105C. This group of auxiliary segments can be used for varying the resonant length and the capacitive coupling length. A second group of auxiliary segments (104X, 104Y) and corresponding switches 105X, 105Y are provided at the other end 110 of main segment 104M, which allows tuning of the resonant length L without affecting the capacitive coupling. Thus, auxiliary segment 104X can be connected to the main segment via switch 105X, and auxiliary segment 104Y can be connected to the auxiliary segment 104X via switch 105Y. Also, the inter-segment gaps are wide enough such that the segment 104M and the segments 104X, 104Y do not have significant capacitive coupling when the corresponding switches 105X, 105Y are open.

In general, the first group may have a different number of auxiliary segments from the second group, and the auxiliary segments in each group may have different shapes and/or dimensions. In some applications, however, it may be desirable to have the same number of auxiliary elements in both groups, and/or to provide auxiliary elements that are substantially identical. This configuration of strip 104 can be used in the embodiment of FIG. 1A, i.e., in conjunction with a conductive strip 102 that does not include switchable auxiliary segments.

The auxiliary segments 102A-102B on conductive strip 102 can be used for tuning the capacitive coupling length l independent from the use of auxiliary elements 104A-104C on conductive strip 104. The use of different groups of auxiliary segments on strips 102, 104 may be used in different combinations for tuning the coupling length and resonator length.

Figure 2:
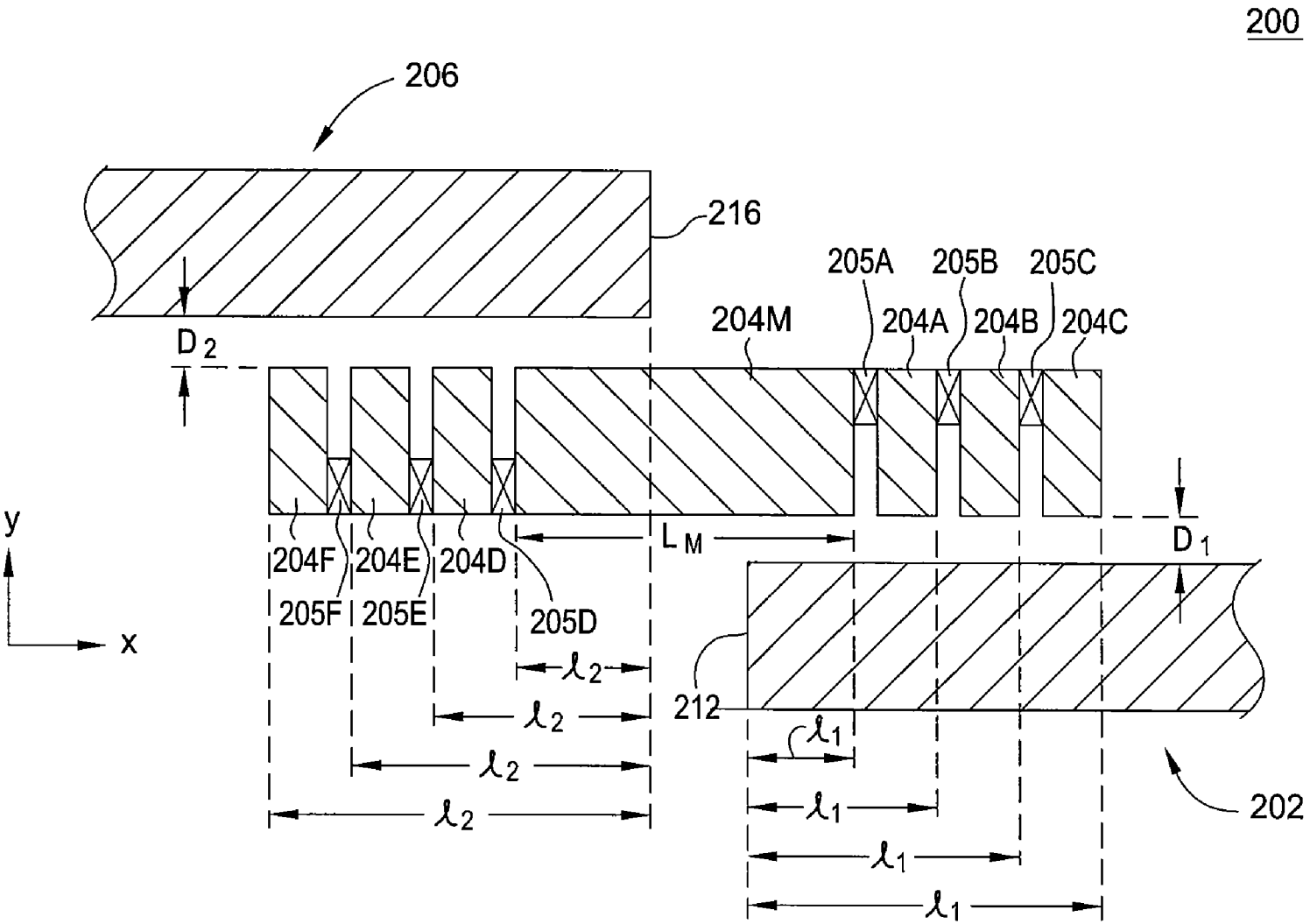
FIG. 2 is a schematic illustration of a tunable microstrip filter according to another embodiment.

Another embodiment of the present invention provides a tunable microstrip filter 200, which is shown schematically in FIG. 2. The filter 200 includes three conductive strips 202, 204 and 206 in the x-y plane and substantially parallel to each other. One of the outer strips 202, 206 serves as the input line and the other serves as an output line. In one embodiment, the conductive strips 202, 204 and 206 are made of the same metals, e.g., copper, silver, and aluminum and alloys or multilayers thereof. The conductive strip 204, which is provided between conductive strips 202 and 206, is separated from strip 202 by a distance D1 and from strip 206 by a distance D2. Both D1 and D2 are typically much smaller than the central wavelength of the filter. Although D1 and D2 may have different values, they are typically equal to each other to provide for ease of design. For example, D1 and D2 may be optimized to reduce passband insertion loss and input return loss.

One portion of the conductive strip 204 is capacitively coupled to conductive strip 202 over a coupling length $l_1$ while the other portion of the conductive strip 204 is capacitively coupled to conductive strip 206 over a coupling length $l_2$. In this example, an input signal from conductive strip 202 is capacitively coupled via length $l_1$ to the conductive strip 204, and then capacitively coupled for output to the conductive strip 206 via length $l_2$.

The conductive strip 204 includes a main segment 204M and two groups of auxiliary segments (or tuning elements), a first group (204A, 204B, 204C) being provided at one end of the segment 204M and a second group (204D, 204E, 204F) being provided at the other end of the segment 204M. Similar to the configurations in FIG. 1A-C, each auxiliary segment has a corresponding switch that can be used to connect the segment to (or disconnect from) its adjacent segment for varying the capacitive coupling lengths $l_1$ and $l_2$. The coupling length $l_1$ (or $l_2$) is defined as the "overlapping" length between one end 212 of strip 202 (or end 216 of strip 206) and a far end of main segment 204M and any connected auxiliary segments, as shown in FIG. 2.

Again, the two groups of switches are provided such that they are located on their respective non-coupling side of the strip. Thus, the first group of switches (205A, 205B, 205C) is provided on a side of strip 204 that is farther away from strip 202, and the second group of switches (205D, 205E, 205F) is provided on the opposite side of strip 204, i.e., farther away from strip 206. Also, the inter-segment gaps are wide enough such that the adjacent segments 204, 204A-204F do not have significant capacitive coupling when their corresponding switches 205A-205F are open.

The resonant length L of the filter 200 is given by the length $L_M$ of the main segment 204M, and any additional auxiliary segments that are connected to the main segment 204M. Thus, the resonant length can be adjusted by electrically connecting to the main segment 204M, one or more auxiliary segments 204A, 204B and 204C using corresponding switches 205A, 205B and 205C, and one or more auxiliary segments 204D, 204E and 204F using corresponding switches 205D, 205E and 205F. Since the center wavelength $\lambda$ of the filter is related to the resonant length L by: approximately $L=\lambda/2$, the center frequency of the filter can again be tuned by adjusting the resonant length L.

Each group of auxiliary segments, i.e., (204A, 204B, 204C) or (204D, 204F, 204F), can be used independently or in conjunction with each other for adjusting the resonant length L and the coupling lengths.

In one embodiment, coupling lengths $l_1$ and $l_2$ are selected to be equal to each other to provide symmetric coupling between strip 202 and the respective strips 204 and 206. For other applications, it may be desirable to provide asymmetric coupling by using different values of $l_1$ and $l_2$. Although not shown in FIG. 2, it is also possible to provide at least one of input and output conductive strips 202, 206 with switchable auxiliary segments such as that illustrated for strip 102 in FIG. 1C. By providing switchable segments for strips 202, 206, capacitive coupling lengths can further be adjusted.

FIG. 3A is a schematic top view of a portion of a tunable microstrip component 300, with conductive strips 302 and 304. FIG. 3A shows a portion of a main segment 304M of conductive strip 304 with auxiliary segments 304A and 304B and corresponding associated switches 305A and 305B. In this example, the main segment 304M and auxiliary segment 304A are provided with tab portions 314M and 314A, which are used as connection points when switches 305A and 305B are closed. Other geometries may also be used for providing connection points with these switches. A schematic cross-sectional view along the line B-B' is shown in FIG. 3B.

FIG. 3B shows the conductive strip 304 disposed over a dielectric layer 360, which is formed over a conductive metal ground plane 350. The conductive strip 304 may have a thickness ranging from about 35 μm to about 70 μm. The dielectric layer 360 may have a thickness ranging from about 1 mm to about 2 mm. Materials and configuration of the dielectric layer and conductive metal ground plane are similar to or the same as those typically used in microstrips.

In this example, switches 305A and 305B are MEMS switches, which, in their normally open positions (shown in FIG. 3B), have a respective end attached to a corresponding auxiliary segment 304A, 304B. Auxiliary segment 304A can be connected to main segment 304M by closing switch 305A, e.g., by applying a bias control voltage across the main segment 304M and switch 305A. Similarly, auxiliary segment 304B can be connected to element 304A by applying a bias control voltage across the element 304A and switch 305B, as shown in the schematic cross-sectional view of FIG. 3C. The MEMS switches used in the microstrip components illustrated herein may either be packaged MEMS switches that are commercially available, e.g., capacitive or inductance-controlled MEMS switches, or they can be monolithic switches that are formed as integrated components in the same substrate as the microstrips.

FIG. 3D is a schematic diagram showing packaged MEMS switches 315A and 315B and their respective connections to auxiliary segments 314A and 314B of the conductive strip 314. As shown, the packaged switches are connected to the main segment 314M and respective auxiliary segments by conventional wirebonding 320. In another embodiment, the MEMS switches can be implemented as monolithic components, in which case, wirebonding will not be necessary. Connections to DC terminals for biasing, i.e., controlling/operating, the MEMS switches to respective auxiliary segments are also shown, e.g., thin strip 330.

A potential drawback with the single resonator configuration shown in FIG. 2 is that numerous switches would be needed to provide seamless tuning over a wide frequency range. An alternative configuration with multiple resonators can contribute to a bandwidth increase, which will allow a reduction of the number of switches required to cover a wide frequency range with coarser tuning step (i.e., larger segment lengths).

FIG. 4 is a schematic illustration of one embodiment of a multiple resonator filter 400, which includes two outer conductive strips 402, 408 serving as input and output lines, and at least two inner conductive strips 404, 406 serving as resonators.

The inner conductive strip 404 has a main segment 404M with two groups of auxiliary segments or tuning elements (404A, 404B, 404C) and (404D, 404E, 404F) and associated switches (405A, 405B, 405C) and (405D, 405E, 405F) for connecting one or more elements to the main segment 404M for adjusting the resonant length.

Similarly, the other inner conductive strip 406 has a main segment 406M with two groups of auxiliary segments or tuning elements (406A, 406B, 406C) and (404D, 406E, 406F) and associated switches (407A, 407B, . . . , 407E, 407F) for connecting one or more elements to the main segment 406M for adjusting the coupling lengths. In this coupled resonator configuration, strips 404 and 406 function as resonators, while also provide energy coupling with neighboring resonators or feedlines. Thus, the various groups of tuning elements in conductive strips 404 and 406 are used to adjust both resonant lengths, as well as capacitive coupling lengths between strips 404, 406 and outer strips 402, 408. In another embodiment, the resonators 404 and 406 may also be bridged and thus electrically coupled with a varactor diode 420 to provide additional coupling strength tuning capability.

Although not shown in the figure, one or both of conductive strips 402, 408 may be provided with switchable auxiliary segments (similar to strip 102 in FIG. 1C) that may be used for adjustable the capacitive coupling with respective resonators 404 and 406.

To illustrate the tuning capability of the microstrip filter of this invention, simulation has been performed for a single-resonator filter 500 shown in FIG. 5. The filter 500 includes outer conductive strips 502 and 506 coupled to respective portions of a middle conductive strip 504 (the resonator) with a total of 16 tuning elements. A main segment 504M has one group of eight tuning elements (504$A_1$, . . . 504$A_8$) at one end, and another group of eight tuning elements (504$B_1$, . . . 504$B_8$) at the other end. Similar to the configuration of FIG. 2, one or more of the tuning elements in each group can be connected to the main segment 504M via one or more corresponding switches (505$A_1$, . . . 505$A_8$) and (505$B_1$, . . . 505$B_8$).

FIGS. 6A-B illustrate the simulated results of the scattering parameters $S_{1,1}$ (solid curve) and $S_{2,1}$ (dashed curve) as a function of the filter frequency in GHz for the tunable microstrip filter 500. FIG. 6A shows the results when all 16 switches are in the on position (i.e., switches closed). This gives a maximum resonant length L, and thus, a bandpass filter with the lowest center frequency. Other higher order harmonics are also shown in the plot. FIG. 6B shows the results when all 16 switches are in the off position (i.e., switches open). This gives a minimum resonant length L, and thus, corresponds to a bandpass filter with the highest center frequency. As shown in FIG. 6A-B, the filter 500 provides a single pole filter tunable from about 1.77 GHz for a center resonator having a maximum length of about 5.2 cm, to about 4.38 GHz for the resonator having a minimum length of about 2.0 cm. A frequency step or increment of approximately 200 MHz is provided by each tuning element with a length of about 2 mm including the switch length.

The embodiments illustrated above relate to various configurations of microstrip components with the conductive strips on the top or front side of a dielectric substrate, i.e., opposite side from the conductive ground plane. In these configurations, the ground plane is provided as a continuous layer on the back side of the dielectric substrate.

In alternative embodiments, conductive strips with switchable auxiliary segments can be provided on the front side of the dielectric, with modifications to the made to the conductive ground plane for implementing other component configurations. These embodiments are shown in FIGS. 7-9.

FIG. 7 illustrates one embodiment of a microstrip component with a truncated ground plane. FIG. 7A shows a top view of a tunable strip antenna 704 using parallel coupled microstrip line 702 for the signal feed. Conductive strip 704 is similar to embodiments previously discussed, with one or more auxiliary segments (shown in hashed patterns, with associated switches omitted for clarity) for tuning the component characteristics such as frequency and/or coupling lengths. In this configuration, however, the ground plane does not cover the entire length of the underside of the dielectric substrate. Instead, the ground plane is truncated, as shown in FIG. 7B (view from top, through dielectric), ending at a boundary 715. The truncated ground plane 710 with its boundary 715 are also shown as superimposed in the top view of FIG. 7A to illustrate the relative positioning of the ground plane boundary 715 and the conductive strips 702 and 704. FIG. 7C is a cross-sectional view taken longitudinally (along line CC') through conductive strip 702, which is located on top of dielectric substrate 720, with the truncated ground plane 710 provided on the back (or bottom) of dielectric substrate 720.

In this example, the boundary 715 is located such that there is a gap (g) along the x-direction between the projections of the ground plane boundary 715 and one end 706 of the conductive strip 704 (i.e., antenna element), as shown in FIG. 7A. In general, the gap can be very small, e.g., the end 706 may even coincide with the boundary 715, as long as there is no conductive ground plane on the backside of the dielectric substrate directly opposite (or beneath) the conductive strip 704. The truncated ground plane 710 acts as a short circuit, and the structure is a quarter-wavelength monopole antenna, with the sum of the length of the strip 704 and the gap (g) in the x-direction being approximately equal to a quarter-wavelength of the resonant frequency. Although the dimension of the ground plane 710 in the x-direction is not important (since it serves only as a feed line), its dimension in the y-direction should be at least as wide as the trace width (w) of the conductive strip 702 to effectively act as short circuit for the signal traveling back to the feedline.

FIG. 8 illustrates another embodiment of a tunable printed dipole antenna using parallel coupled microstrip line. In this case, the conductive strips are printed on both sides of the dielectric substrate to form a dipole. FIG. 8A is a schematic front or top view showing conductive strips 802, 804 printed on one side of a dielectric substrate. Conductive strip 810 has a tapered section 812 for electrically connecting to one end of the conductive feed strip 802, which is coupled to an antenna strip 804. Although strip 802 is shown to have a tapered portion in this example, it is not generally required.

FIG. 8B is a schematic back view of the conductive pattern printed on the other side of the dielectric substrate. The ground plane 850 does not extend across the entire length of the backside of the dielectric substrate. Instead, it has a tapered portion 852 that connects to one end of a conductive strip 862, forming an antipodal strip line that serves as a feed strip to antenna strip 864. Although strip 862 is shown to have a tapered portion in this example, it is not generally required. In this case, the tapered ground plane 850 simply serves as a part of a feedline. This structure can be considered as a balun (balanced to unbalanced transformer), in which the tapering transforms the unbalanced transmission line (microstrip line 810, 850) to the balanced structures (dipole antenna formed by strips 802, 862).

Conductive strips 802, 804, 862 and 864 are similar to embodiments previously discussed, with one or more auxiliary segments (shown in hashed patterns) for tuning the component characteristics such as frequency and/or coupling lengths.

To help visualize the relative layout of the conductive patterns on both sides of the dielectric substrate, the conductive patterns on the front and back sides are superimposed on each other, and illustrated in FIG. 8C, which is a "transparent" front view, with the ground plane pattern superimposed on the pattern of FIG. 8A. This configuration provides for both tunable resonant cavity and coupling length.

FIG. 9A illustrates one embodiment of a tunable planar inverted-F type antenna (PIFA) 900 using parallel coupled microstrip line. As discussed below, the PIFA 900 can operate both as a quarter-wave length resonant antenna with a small size while maintaining reasonable bandwidth, and as a half-wavelength resonant antenna. FIG. 9A is a schematic front view of conductive strips 902 and 904, which are parallel coupled and each has one or more auxiliary segments or tuning elements (904A, B, C; and 902A, B, C). Both conductive strips 902 and 904 can be adjusted for resonator length and/or coupling length, similar to other embodiments previously described. A conductive strip 910 has a tapered portion connected to one end of the conductive strip 904, which acts as a feed line. This parallel coupled tunable feed line configuration allows tuning of both the resonant frequency and the capacitive coupling length of the feeder to optimize antenna return loss and also allows flexible frequency tuning of the antenna's operating frequency.

In this embodiment, the ground plane 950 is truncated, i.e., not being continuous across the entire backside of the dielectric substrate. The conductive ground plane 950 is shown as superimposed on the front view of FIG. 9A (viewing through the dielectric substrate), with the ground plane ending at the boundary 955. That is, there is no ground plane at the back side of the dielectric substrate at locations directly below the conductive strips 902, 904 and the tapered portion 912.

The PIFA configuration of FIG. 9A also represents a novel structure, even without the tuning elements for the respective strips 902, 904. The PIFA typically operates as a quarter-wave resonant antenna, with the far end 906 of conductive strip 904 being the open-circuited end of the antenna. The ground plane 950 is truncated at a location of the short-circuited end 908 of this PIFA antenna. That is, the short-circuited end of the antenna is located at 908 within the feed line 910. This is quite different from conventional PIFAs where the feed line location and the short-circuited location are located at separate points mostly for the purpose of input impedance matching.

The truncated ground plane 950 acts as a short circuit to the signal coming back through the feed line 910. This ensures that the first operation point of the antenna occurs at the quarter-wave length resonance of a structure that includes a portion of the feed line 910—i.e., the total length given by L1 (between 908 and the connection point 914) and L2 (between point 914 and the end 906 of strip 904) being approximately equal to a quarter-wavelength at the first resonant frequency.

In addition, the antenna also operates at half-wavelength resonance because the conductive strip 904 can resonate and radiate with both ends 906, 907 being open circuited, with the length of strip 904 being approximately equal to a half-wavelength of the second resonant frequency. Such an arrangement allows operation in dual-band or multi-band applications.

Although FIG. 9A shows the truncated ground plane 950 extending (in the x-direction) from beyond the left side of strip 910 to beyond the end 906 of strip 904, in other embodiments, the ground plane may have a smaller extent along the x-direction, e.g., as long as it is sufficiently wide to cover the width of the feed line 910. In another example, the length of the radiation element (L1+L2) is about 44 mm from the feed-point 908 and the truncated ground plane width in the x-direction is about 60 mm.

In the conventional PIFA structure, it is difficult to tune the input impedance with any type of tuning elements as the distance between the short pin and the feed pin location would primarily determine the input impedance characteristics. The PIFA structure such as that in FIG. 9A allows the use of tuning element to adjust the length of the resonator, namely center frequency of the antenna, as well as the length of the capacitive coupling, namely, to perform input impedance matching.

FIG. 9B shows simulation results for an example of such an antenna, plotting the scattering parameter $S_{1,1}$ as a function of frequency in GHz and illustrating the dual band characteristic. The quarter-wavelength resonance occurs at around 1.6 GHz and the half-wavelength resonance occurs at around 3.6 GHz providing the dual-frequency operation.

FIG. 10 is a schematic diagram illustrating a multi-band, multi-service system 1000 that incorporates two tunable microstrip preselect filters 1004, 1012, e.g., as illustrated in FIGS. 2-5. Filters 1006, 1010 are the RF front end of the transceiver and they convert RF frequency signal to intermediate frequency signals for receive path, and vice versa for the transmit path. The baseband signal processor 1008 typically includes analog to digital converters ADC/DAC followed by ASIC (application specific integrated circuit) or FPGA (field programmable gate arrays). The tunable preselect filter 704, 712 are the ideal components to select desirable band of operation before or after RF front end to avoid excess noise loading and signal interference.

In system 1000, tunable filter 1004 is tuned to a desired center frequency with a given bandwidth, and a selected signal from a multiband/broadband antenna 1002 is passed to a radio-frequency integrated circuit (RFIC) 1006 for processing at the IF/backplane 1008. Signal from IF/backplane 1008 is sent to the RFIC 1010, and tunable filter 1012 is tuned to pass a RF signal to the antenna 1002. The antenna 1002 can also be a tunable antenna such as the embodiments of the present invention.

While the foregoing is directed to embodiments of the present invention, other and further embodiments may be devised without departing from the scope of the invention. The scope of the invention is determined by the claims that follow.

The invention claimed is:

1. A method of tuning a microstrip device, comprising:

configuring a first conductive strip on a planar surface and over a conducting ground plane, the first conducting strip being formed of separated conducting segments arranged in a physical series on the planar surface and a second conductive strip located on the planar surface and over the conducting ground plane, a dielectric substrate being between the ground plate and the conducting strips;

providing a first set of micro-electromechanical system (MEMS) switches;

wherein the conducting strips are configured in a parallel arrangement and separated by a gap;

wherein part of one edge of the first conducting strip faces and is adjacent to part of one edge of the second conducting strip; and wherein each adjacent pair of the separated conducting segments are electrically connectable via a corresponding one of the MEMS switches; and tuning a parameter of the device by electrically connecting at least a first of the separated conducting segments of the first group to the first end of the first conductive strip using a first of the MEMS switches of the first set.

2. The method of claim 1, further comprising:

tuning the parameter of the device by electrically connecting one or more of the other separated conducting segments to the first of the separated conducting segments of the first group using one or more of the MEM switches of the first set.

3. The method of claim 1, further comprising:

providing a second set of MEMS switches and a second group of separated conducting segments, the second group of separated conducting segments disposed to form a second series at a second end of the first conductive strip, each separated conducting segment of the second group being associated with a corresponding one of the MEMS switches of the second set; and tuning a parameter of the device by electrically connecting at least a first of the separated conducting segments of the second group to the second end of the first conductive strip using a first of the MEMS switches of the second set.

4. The method of claim 3, wherein each MEMS switch of the second set is disposed on the same side of the first conductive strip as the MEMS switches of the first set.

5. A tunable microstrip device, comprising:

a conducting ground plane;

a planar dielectric substrate having a planar surface;

a first conducting strip located on the planar surface and over the conducting ground plane, the first conducting strip being formed of a first group of separated conducting segments arranged in a physical series on the planar surface;

a second conducting strip located on the planar surface and over the conducting ground plane, the dielectric substrate being between the ground plate and the conducting strips; and a first set of MEMS switches; and wherein the conducting strips are configured in a parallel arrangement and separated by a gap;

wherein part of one edge of the first conducting strip faces and is adjacent to part of one edge of the second conducting strip; and wherein each adjacent pair of the separated conducting segments are electrically connectable via a corresponding one of the MEMS switches.

6. The device of claim 5, comprising a resonator formed by the first conducting strip and any separated conducting segments connected to the first conducting strip.

7. The device of claim 6, wherein the device is an antenna having an input or output coupling tunable by connecting one or more of the separated conducting segments of the first group to the first conducting strip via one or more of the MEMS switches and having a central response frequency tunable by connecting one or more of the separated conducting segments of the first group to the first conducting strip via one or more of the MEMS switches.

8. The device of claim 5, wherein the first conductive strip further comprises a second set of MEMS switches and a second group of separated conducting segments disposed to form a second series at a second end of the first conducting strip, each separated conducting segments of the second group being associated with a corresponding one of the MEMS switches of the second set, wherein a first of the MEMS switches of the second set is adapted to electrically connect one of the separated conducting segments of the second group to the second end of the first conducting strip via a MEMS switch of the second set, and each other MEMS switch of the second set is adapted to electrically connect one of the separated conducting segments in the second group to another of the separated conducting segments of the second group that is closer in the second series to the first conducting strip.

9. The device of claim 8, wherein each MEMS switch of the second set is disposed on a same side of the first conductive strip as the MEMS switches of the first set.

10. The device of claim 8, comprising a resonator formed by the main segment and any separated conducting segments from the first and the second groups connected to the first conducting strip.

11. The device of claim 8, wherein the separated conducting segments in the first group and the second group are quasi-rectangular shaped.

12. The device of claim 8, wherein the first and second groups of separated conducting segments have a same number of conducting strips, and all separated conducting segments in each group are similar.

13. The device of claim 8, further comprising:

a third conductive strip having a coupling section disposed adjacent to a second capacitive coupling section of the first conductive strip, the third conductive strip and the second conductive strip being on opposite sides of the first conductive strip;

wherein the second coupling section of the first conductive strip is formed by at least a portion of the first conducting strip and one or more separated conducting segments of the second group; and the second set of MEMS switches and the first set of MEMS switches are disposed on opposite sides of the first conductive strip.

14. The device of claim 13, wherein the device is a filter having an input or output coupling tunable by connecting one or more of the separated conducting segments to the first conducting strip via one or more of the MEMS switches, and having a central response frequency tunable by connecting one or more of the separated conducting segments to the first conducting strip via one or more of the MEMS switches.

15. The device of claim 5, wherein the second conductive strip is a feed line of the device, and a section of the second conductive segment adjacent the first capacitive coupling section of the first conductive segment comprises a main segment and a third group of separated conducting segments forming a series at an end of the main segment of the second conductive strip; and a third set of MEMS switches, each switch of the third set adapted to electrically connect a corresponding one of the separated conducting segments of the third group to one of the segments of the second conductive strip.

16. The device of claim 15, wherein each of the MEMS switches of the third set is disposed on a second side of the second conductive strip that is farther away from the first conductive strip than the first side of the second conductive strip.

17. The device of claim 5, wherein the first and second conductive strips are provided on a front side of the dielectric substrate; and the device comprises a conductive ground plane on a back side of the dielectric substrate.

18. The device of claim 5, wherein the first and second conductive strips are on a front side of the dielectric substrate and the conductive ground plane is on a back side of the dielectric substrate, and the conductive ground plane has a boundary at a location opposite an intermediate point of the first conductive strip.

19. The device of claim 5, further comprising two conductive strips provided on the conductive ground plane on a side of the dielectric opposite to the first and second conductive strips, each of the conductive strips on the conductive ground plane comprising one or more switchable separated conducting segments for tuning a characteristic of the device.

20. The device of claim 19, wherein the device is one of a dipole antenna and a planar inverted-F type antenna.

* * * * *